US005200578A

United States Patent [19]

Brucker

[11] Patent Number: 5,200,578

[45] Date of Patent: Apr. 6, 1993

[54] HIGH VOLTAGE FEEDTHROUGH BUSHING

[75] Inventor: John P. Brucker, Espanola, N. Mex.

[73] Assignee: The United States of America as represented by the United States Department of Energy, Washington, D.C.

[21] Appl. No.: 799,467

[22] Filed: Nov. 27, 1991

[51] Int. Cl.[5] ..... H01B 17/26

[52] U.S. Cl. ..... 174/152 R; 174/11 BH; 174/12 BH; 174/14 BH; 174/15.3; 174/18; 174/73.1; 174/142; 174/167

[58] Field of Search ..... 174/152 R, 142, 152 E, 174/11 BH, 12 BH, 14 BH, 15.3, 31 R, 31.5, 178, DIG. 10, 19, 73.1, 143, 153 R, 167, 18

[56] References Cited

U.S. PATENT DOCUMENTS

| | | | |
|---|---|---|---|
| 1,846,917 | 2/1932 | Stevenson | 174/142 X |
| 2,557,928 | 6/1951 | Atkinson | 174/18 |
| 2,728,810 | 12/1955 | Ziehr | 174/167 |
| 3,197,551 | 7/1965 | Linderholm | 174/73.1 |

FOREIGN PATENT DOCUMENTS

| | | | |
|---|---|---|---|
| 0249506 | 3/1926 | United Kingdom | 174/11 BH |

*Primary Examiner*—Leo P. Picard
*Assistant Examiner*—Hyung S. Sough
*Attorney, Agent, or Firm*—Ray G. Wilson; Paul D. Gaetjens; William R. Moser

[57] ABSTRACT

A feedthrough bushing for a high voltage diode provides for using compression sealing for all sealing surfaces. A diode assembly includes a central conductor extending through the bushing and a grading ring assembly circumferentially surrounding and coaxial with the central conductor. A flexible conductive plate extends between and compressively seals against the central conductor and the grading ring assembly, wherein the flexibility of the plate allows inner and outer portions of the plate to axially translate for compression sealing against the central conductor and the grading ring assembly, respectively. The inner portion of the plate is bolted to the central conductor for affecting sealing. A compression beam is also bolted to the central conductor and engages the outer portion of the plate to urge the outer portion toward the grading ring assembly to obtain compression sealing therebetween.

3 Claims, 2 Drawing Sheets

HIGH VOLTAGE FEEDTHROUGH BUSHING

This invention is the result of a contract with the Department of Energy (Contract No. W-7405-ENG-36).

BACKGROUND OF INVENTION

This invention relates to high voltage power supplies and, more particularly, to bushings for connecting external components to components located in a vacuum environment.

High voltage systems frequently must provide for connecting external components to components located in a vacuum environment. A high voltage bushing must provide a continuous electrical path between the two environments and must provide a seal between the two environments over a variety of operating conditions. High voltage bushings are often also filled with a gaseous dielectric, i.e., $SF_6$, that must be contained and sealed from both vacuum and external environments.

Conventional bushings include a central conductor surrounded by a stacked insulator assembly that contains the dielectric fluid. Any seal between the dielectric fluid and the surrounding vacuum must be able to accommodate circumferential variations in the stacked insulator assembly that arise from stacking tolerances in the component parts of the insulator assembly. Further, a seal must accommodate differential thermal expansion between the central conductor and the surrounding insulator assembly.

Conventional bushings have used a piston-type seal structure where the sealing conductor is a cylinder and seals to an axially-oriented surface on the central conductor. Axial differential movement can then be accommodated between the insulator assembly and the central conductor. Electrical contact between the sealing conductor and central conductor is then generally maintained by a wiping contact, such as flexible conductive fingers extending from the sealing conductor to the central conductor.

The prior art devices use rigid conductors for the sealing conductor and require many parts to form an effective seal while accommodating the variable tolerances in the stacked insulator assembly. Further, the sliding seals are prone to wear and leakage and the sliding electrical contacts are subject to burning and arcing under high current conditions.

These and other problems of the prior art are addressed by the present invention and a flexible conductor assembly provides compression sealing and bolted contact electrical connection between sealing assembly and the central conductor.

Accordingly, it is an object of the present invention to provide only compression seals in a high voltage bushing assembly.

It is another object of the present invention to accommodate component assembly tolerances between sealing surfaces in a central conductor and an insulator assembly in a high voltage bushing while obtaining bolted electrical connections between components.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a feedthrough bushing for a high voltage diode. A central conductor extends axially through said bushing. A grading ring assembly circumferentially surrounds the central conductor and is coaxial with the conductor. A conductive sealing assembly is bolted to the central conductor and compressively seals against both the central conductor and the grading ring assembly.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE DRAWINGS

Figure 1:
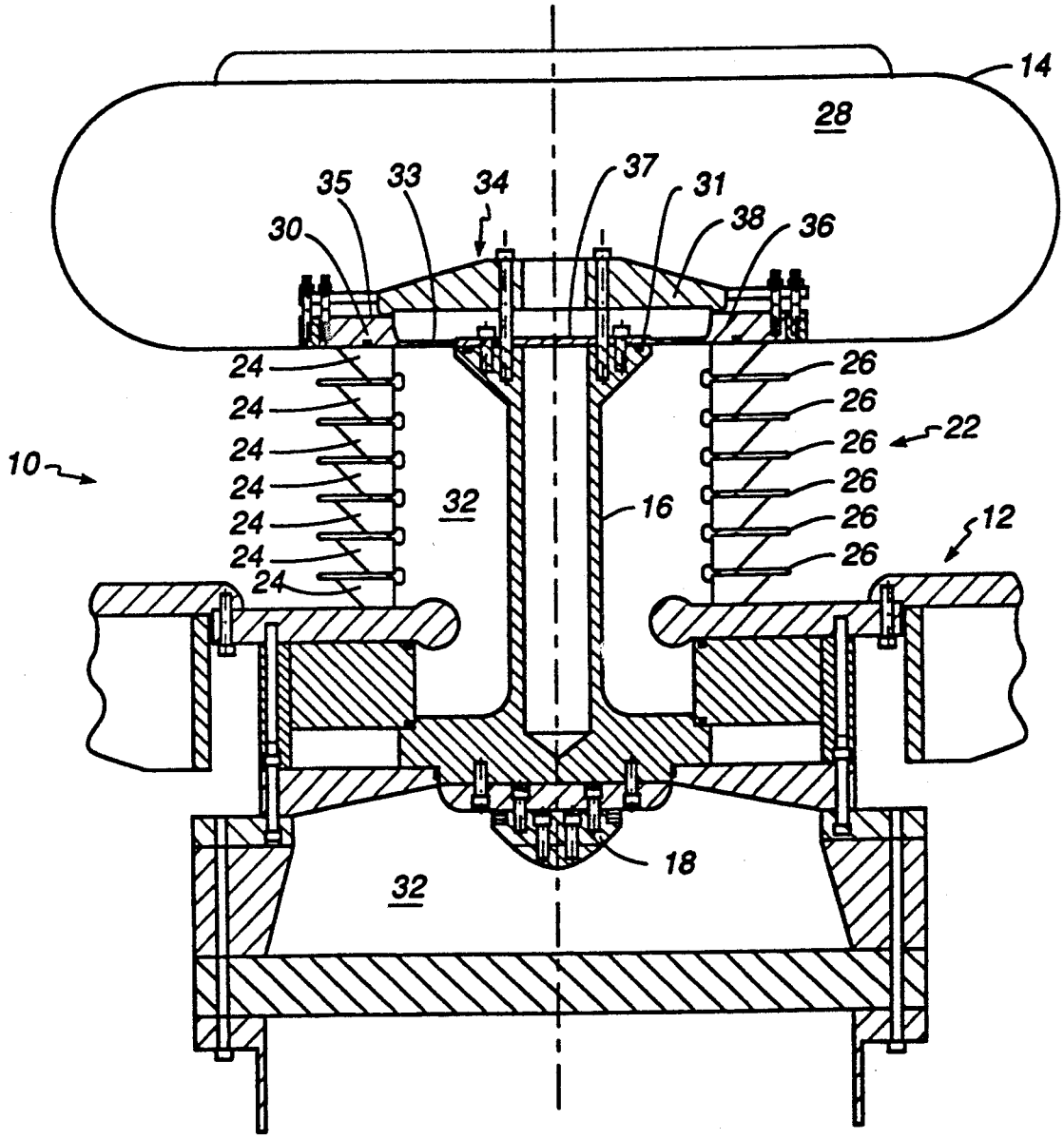
FIG. 1 is a cross-sectional view of one embodiment of the present invention.

Referring first to FIG. 1, there is shown a cross-sectional view of one embodiment of the present invention. High voltage diode bushing assembly 10 includes a central conductor 16 within diode housing 12 and axially extending between switch 18 and cathode 14. It will be understood that the volume 28 within housing 12 and containing cathode 14 is a vacuum that must be sealed from external environments.

Grading ring assembly 22 circumferentially surrounds central conductor 16 and is coaxial with conductor 16. Grading ring assembly 22 conventionally consists of alternating layers of insulator rings 24 and aluminum rings 26 to maintain voltage gradients that do not cause any breakdown in materials forming the surrounding environment. In the configuration shown in FIG. 1, compression seals are provided between adjacent insulator rings 24 and aluminum rings 26. Volumes 32, defined by the structure of insulator assembly 22 and diode housing 12 that surrounds central conductor 16, are conventionally filled with a dielectric fluid, such a $SF_6$ gas.

Conductive sealing assembly 34 electrically connects cathode 14 with central conductor 16 while using compressive seals to seal between vacuum environment 28 and dielectric volume 32. In accordance with the present invention, sealing assembly 34 enables the electrical connection to be a tightly bolted contact and enables compression seals 30 and 31 to be formed between a flexible conductive plate 35 and both central conductor 16 and grading ring assembly 22, i.e., a stacked insulator assembly. Flexible conductive plate 35 is provided with sufficient flexibility to enable plate 35 to flex axially to accommodate tolerance mismatches between central conductor 16 and grading ring assembly 22, as well as axial movement during sealing ring compression in assembly 22 and during differential thermal expansion and contraction. Thus, outer portions of plate 35 and inner portions of plate 35 can translate axially relative to one another to provide sealing surfaces at the axial locations of grading ring assembly 22 and central conductor 16. Compression beam 38 operates as a cantilever to exert a sealing force against a portion of plate 35 adjacent grading ring assembly 22 to compress seal 30.

As used herein, "flexible" means that adjacent portions of a piece can translate to different axial locations. "Conductive" or "conductor" means a component formed from a material that readily conducts electrical current, such as aluminum, copper, and the like.

FIG. 1 depicts a preferred embodiment of a conductive sealing assembly 34 according to the present invention. Flexible conductive plate 35 includes an outer ring 36 for sealing against grading ring assembly 22, an inner ring 37 for electrically connecting with and sealing against central conductor 16, and center ring 33 electrically connecting outer ring 36 with inner ring 37. Center ring 33 is relatively thin, i.e., a diaphragm-like ring, and has a thickness that is effective for enabling outer ring 36 to axially translate against compression seal 30 to seal to grading ring assembly 22 after inner ring 37 is bolted to central conductor 16 and sealed to compression seal 31.

In an exemplary embodiment, flexible conductive plate 35 has the following dimensions (all in inches):

| | Thickness | O.D. | I.D. |
|---|---|---|---|
| Inner ring 37 | 0.375 | 8 | — |
| Center ring 33 | 0.06 | 12 | 8 |
| Outer ring 36 | 1 | 16 | 12 |

Compression beam 38 acts to urge outer ring 36 into sealing engagement with compression seal 30 against grading ring assembly 22. Compression beam 38 is a circular plate having a tapered cross section with a peripheral ridge for contacting outer ring 36. Compression beam 38 is bolted toward central conductor 16 for exerting a sealing force against outer ring 36. Inner ring 37 is bolted directly to central conductor 16 and seals with compression seal 31.

Figure 2:
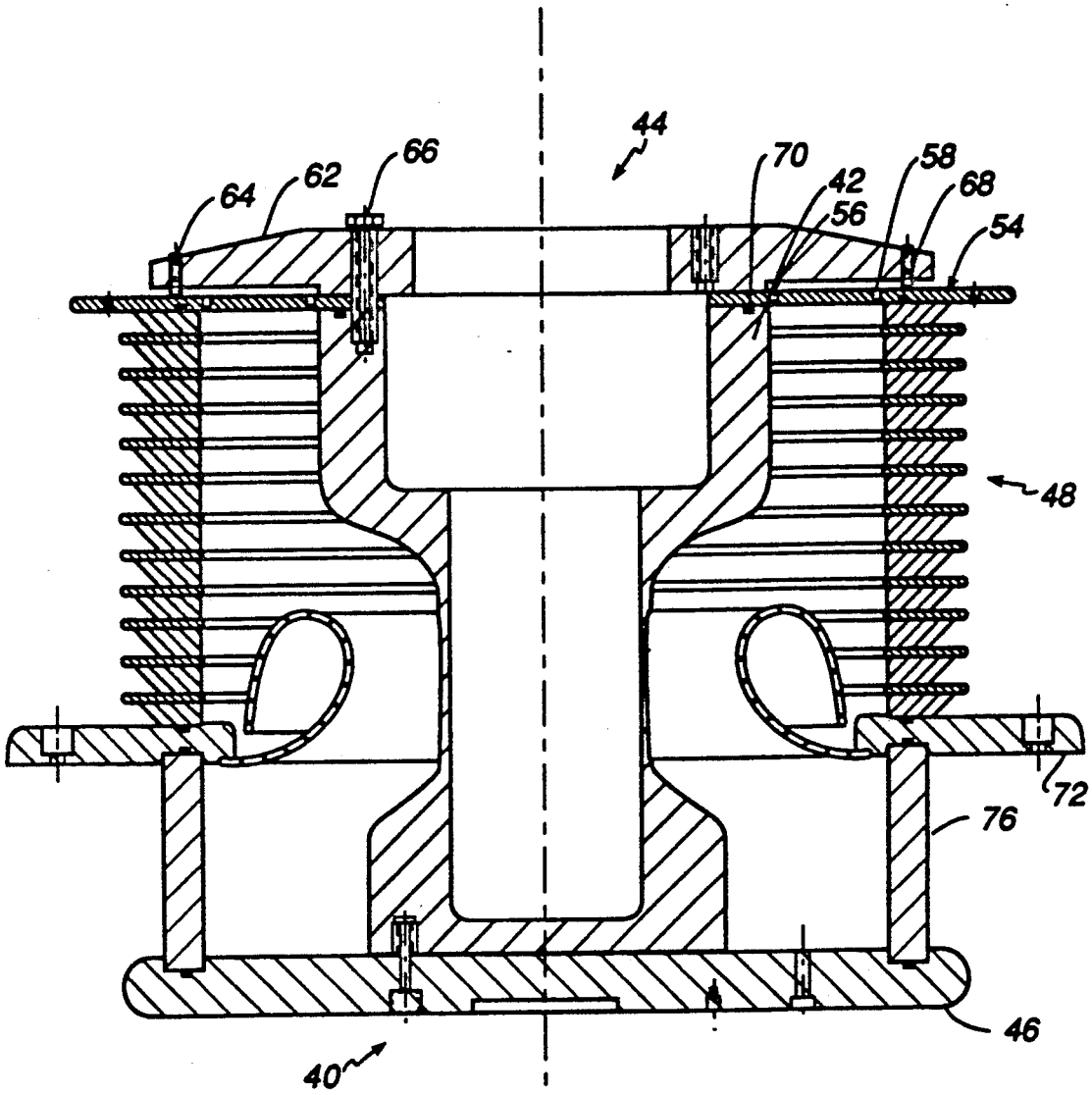
FIG. 2 is a cross-sectional view of a second embodiment of the present invention.

FIG. 2 depicts another embodiment of the present invention. High voltage diode bushing assembly 40 includes grading ring assembly 48 with central conductor 42 located coaxially therein. Conductive sealing assembly 44 is bolted to central conductor 42 for sealing the interior of grading ring assembly 48 from a surrounding vacuum, as explained for FIG. 1. Bushing assembly is completed by diode mounting ring 72, switch mounting plate 46, and insulator tube 76.

Conductive sealing assembly 44 includes flexible conductive plate 54, compression beam 62, mounting bolts 66, and compression screws 64. Flexible plate 54 defines grooves 56 and 58 that are deep enough to permit inner and outer portions of plate 54 to relatively translate for compression sealing against compression seals 70 and 68, respectively. In one exemplary embodiment, plate 54 is 0.375 inches thick and 26.25 inches diameter with grooves 56 and 58 machined to a depth of about 0.344 inches at a width of 0.25 inches. Groove 56 was located at a radius of 6.69 inches and groove 58 at a radius of about 9.375 inches.

Compression beam 62 is bolted to central conductor 42 for electrically connecting an inner portion of flexible plate with central conductor 42 while compressing seal 70. Compression beam 62 is a plate with a tapered cross-section and defines a plurality of threaded holes for screws 64 around the periphery of beam 62. The thickness of beam 62 is relieved above grading ring assembly 48 to accommodate translation of outer portions of flexible ring 54. Screws 64 are urged against an outer portion of flexible plate 54 to translate the outer portion for compressing seal 68 and sealing between flexible plate 54 and grading ring assembly 48. The sealing force can then be controlled along the periphery of compression beam 62 for uniform sealing. A cathode assembly (not shown), such as cathode 14 (FIG. 1), is attached to the outer rim of flexible plate 54. Flexible plate 54 thereby provides a low resistance electrical path from central conductor 42 to the cathode.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A feedthrough bushing for a high voltage diode, comprising:

a central conductor extending axially through said bushing;

a grading ring assembly circumferentially surrounding and coaxial with said central conductor;

a flexible conductive plate having an outer ring for compressively sealing against said grading ring assembly, an inner ring for compressively sealing against said central conductor, and a center ring therebetween having a thickness effective for relative translation of said outer ring and said inner ring, for said compression sealing against said grading ring assembly and said central conductor, respectively; and compression beam means bolted to said central conductor for urging said flexible conductive plate toward said grading ring assembly to obtain said compression sealing therebetween.

2. A feedthrough bushing for a high voltage diode, comprising:

a central conductor extending axially through said bushing;

a grading ring assembly circumferentially surrounding and coaxial with said central conductor;

a flexible conductive plate having a first groove interior of said grading ring assembly and a second groove exterior of said central conductor, said first and second grooves having a depth effective for relative translation of outer and inner portions of said flexible conductive plate, respectively, into compression sealing contact with said grading ring assembly and said central conductor, respectively; and compression beam means bolted to said central conductor for urging said flexible conductive plate toward said grading ring assembly to obtain said compression sealing therebetween.

3. A feedthrough bushing according to claim 2, where said compression beam means further includes a compression beam electrically connecting said flexible conductive plate with said central conductor and bolted to said central conductor for compressively sealing said inner portion of said flexible conductive plate against said central conductor, said compression beam further including compression screws above said outer portion of said flexible conductive plate for providing a variable circumferential force for compressively sealing said outer portion of said flexible conductive plate against said grading ring assembly.

* * * * *